US010683756B2

(12) United States Patent
Griffin et al.

(10) Patent No.: US 10,683,756 B2
(45) Date of Patent: Jun. 16, 2020

(54) SYSTEM AND METHOD FOR COOLING A FLUIDIZED CATALYTIC CRACKING EXPANDER

(71) Applicant: Dresser-Rand Company, Olean, NY (US)

(72) Inventors: Timothy R. Griffin, Allegany, NY (US); George H Seamon, Allegany, NY (US); Nicholas Vachon, Olean, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 607 days.

(21) Appl. No.: 15/423,226

(22) Filed: Feb. 2, 2017

(65) Prior Publication Data

US 2017/0218770 A1 Aug. 3, 2017

Related U.S. Application Data

(60) Provisional application No. 62/290,759, filed on Feb. 3, 2016.

(51) Int. Cl.
*F01D 5/08* (2006.01)
*C10G 11/18* (2006.01)
(Continued)

(52) U.S. Cl.
CPC ..... *F01D 5/081* (2013.01); *C10G 11/18* (2013.01); *C10G 75/00* (2013.01); *F01D 5/082* (2013.01);
(Continued)

(58) Field of Classification Search
CPC ..... F01D 5/081; F01D 5/082; F01D 11/006
See application file for complete search history.

(56) References Cited

U.S. PATENT DOCUMENTS 5,472,313 A * 12/1995 Quinones ..... F01D 5/082 415/115
6,022,190 A 2/2000 Schillinger
(Continued)

FOREIGN PATENT DOCUMENTS

EP 2679770 A1 1/2014
WO 2014120135 A1 8/2014

OTHER PUBLICATIONS

PCT International Search Report and Written Opinion dated Apr. 12, 2017 corresponding to PCT Application PCT/US2017/0163413 filed Feb. 3, 2017.

*Primary Examiner* — J. Todd Newton
*Assistant Examiner* — Sabbir Hasan

(57) ABSTRACT

Systems and methods for cooling a rotor assembly disposed within a cavity of an expander fluidly coupled with a cooling source are provided. The system may include an annular body disposed on a rotor disc of the rotor assembly. The rotor disc may also include a plurality of rotor blades mounted thereto via respective roots. The annular body may define at least one fluid passageway fluidly coupling the roots and the cooling source. The annular ring may be configured to substantially prevent mixing of the flue gas with a coolant provided by the cooling source and flowing through the at least one fluid passageway and contacting at least one root. The system may also include a plurality of seal members, each disposed between respective platforms of adjacent rotor blades and configured to substantially prevent the flue gas flowing though the expander from mixing with the coolant.

9 Claims, 7 Drawing Sheets

(51) Int. Cl.

| | |
|---|---|
| ***C10G 75/00*** | (2006.01) |
| ***F01D 11/00*** | (2006.01) |
| ***F01D 25/24*** | (2006.01) |
| *F01D 5/30* | (2006.01) |

(52) U.S. Cl.
CPC ..... *F01D 11/006* (2013.01); *F01D 25/24* (2013.01); *C10G 2300/4006* (2013.01); *F01D 5/3038* (2013.01); *F01D 11/001* (2013.01); *F05D 2230/60* (2013.01); *F05D 2260/22141* (2013.01)

(56) References Cited

U.S. PATENT DOCUMENTS

| | | | | |
|---|---|---|---|---|
| 6,508,623 | B1 | 1/2003 | Shiozaki et al. | |
| 8,137,072 | B2 * | 3/2012 | Kim | F01D 5/22 416/190 |
| 8,162,598 | B2 | 4/2012 | Liang | |
| 8,348,615 | B2 | 1/2013 | Bluck et al. | |
| 8,371,127 | B2 | 2/2013 | Durocher et al. | |
| 8,480,353 | B2 | 7/2013 | Koyabu et al. | |
| 8,814,518 | B2 | 8/2014 | Harris, Jr. et al. | |
| 8,894,352 | B2 | 11/2014 | Berrong et al. | |
| 8,973,371 | B2 | 3/2015 | King et al. | |
| 8,992,168 | B2 | 3/2015 | Norris et al. | |
| 9,011,078 | B2 | 4/2015 | Winn et al. | |
| 9,033,666 | B2 | 5/2015 | Bosco | |
| 9,140,133 | B2 | 9/2015 | Hagan et al. | |
| 9,151,226 | B2 | 10/2015 | Zimmerman et al. | |
| 9,169,729 | B2 | 10/2015 | Xu | |
| 9,260,979 | B2 | 2/2016 | Lee et al. | |
| 2006/0213202 | A1 | 9/2006 | Fukutani | |
| 2015/0204245 | A1 | 7/2015 | Marasco et al. | |
| 2017/0044908 | A1 * | 2/2017 | Griffin | F01D 5/082 |

* cited by examiner

SYSTEM AND METHOD FOR COOLING A FLUIDIZED CATALYTIC CRACKING EXPANDER

CROSS-REFERENCE TO RELATED APPLICATIONS

This application claims the benefit of U.S. Provisional Patent Application having Ser. No. 62/290,759, which was filed Feb. 3, 2016. The aforementioned patent application is hereby incorporated by reference in its entirety into the present application to the extent consistent with the present application.

BACKGROUND

A fluidized catalytic cracking (FCC) process converts high-molecular weight hydrocarbon fractions of petroleum crude oils to usable products (e.g., gasoline) with the aid of a catalyst in a reactor. High temperature flue gas (e.g., 650° C. to 790° C.) may be produced from the FCC process and passed through a FCC expander to extract and convert energy from the flue gas into mechanical work that may be used to drive process machinery. Although the flue gas is typically processed through multiple stages of separation, an undesirable amount of catalyst particulate typically remains entrained in the flue gas and is passed through the FCC expander.

Accordingly, the high temperatures, corrosive nature, and erosive tendency of the hot, catalyst particulate laden flue gas may cause rapid deterioration by erosion or corrosion of the rotating and stationary components of the FCC expander, including but not limited to, the inlet, the rotor assembly including the rotor disc and blades, and the stator assembly. In particular, the rim of the rotor disc and the respective roots of the rotor blades attached to the rotor disc are susceptible to catalyst build up during operation. This region of the FCC expander is also subject to turbulent and complex flows. Cooling steam may be introduced into the fore, or upstream, side of the cavity in which the rotor disc is disposed, and sealing steam or air may be discharged into the cavity on the aft, or downstream, side of the cavity. Hot, corrosive, and catalyst particulate laden flue gas may be drawn into the cavity, thereby mixing with the cooling steam and contacting the rotor disc proximal the roots of the rotor blades. Additionally, the catalyst may separate from the flue gas and may be deposited on the roots of the rotor blade and on and under the rim of the rotor disc. Corrosion may thus occur, causing the penetration of corrosion spikes into the base material of the rotor blades and rotor disc. Further, mixing of the hot flue gas with the cooling steam increases the temperature of the cooling steam and makes it less effective at cooling the rotor blades and disc, thereby resulting in increased metal temperatures. Such deposits, erosion, corrosion, and/or increased metal temperatures may lead to the reduced reliability and, in some cases, failure of the FCC expander.

Proposed solutions to the deposition, erosion, corrosion, and/or increased metal temperatures have included additional process equipment for the removal of the catalyst particulate entrained in the flue gas, selection of more corrosion resistant materials for the construction of FCC expander components, the use of coatings to improve the corrosion resistance of the base materials of the FCC expander, and the use of additional cooling steam. Each of these proposed solutions have been shown to be effective; however, certain drawbacks are present in each of these proposed solutions. For example, economic considerations may not allow for the additional cost of certain corrosion resistant materials or coating. In addition, the operation of the FCC expander may limit the thickness of the coating, thereby limiting the selection of coating depending on the base material employed. Also, the additional process equipment utilized to further separate the catalyst particulate from the flue gas may enlarge the footprint of the plant or facility, which may be limited in certain environments. Further, the use of additional cooling steam may increase the cost of utility steam consumption and the likelihood of erosion of the rotor disc and rotor blades.

What is needed, therefore, is an improved system and method for cooling the FCC expander components while reducing the erosion and corrosion of the FCC expander components subjected to hot, catalyst particulate laden flue gas produced from the FCC process.

SUMMARY

Embodiments of the disclosure may provide a system for cooling a rotor assembly disposed within a cavity of an expander fluidly coupled with a cooling source. The system may include an annular body disposed on a rim of a rotor disc of the rotor assembly. The rotor disc may be configured to rotate about a center axis of the expander. An outer radial surface of the rotor disc may define a plurality of slots circumferentially about the center axis. The annular body may include a first axial portion including a plurality of axial ribs disposed on and circumferentially about the rim of the rotor disc, each axial rib and an adjacent axial rib forming an axial slot therebetween. The annular body may also include a radial portion extending radially outward from the first axial portion and spaced from the rotor disc forming an annular gap therebetween. The annular gap and the axial slots may form at least one fluid passageway fluidly coupling the cooling source and the rotor assembly. The annular body may further include a second axial portion extending axially from the radial portion and including a plurality of teeth having a saw tooth configuration. The system may also include a plurality of seal members. Each seal member may be disposed between respective platforms of adjacent rotor blades, each rotor blade including a root fitted in a respective slot of the plurality of slots. Each seal member may be configured to substantially prevent a flue gas flowing though the expander from entering the cavity.

Embodiments of the disclosure may further provide an expander for a fluid catalytic cracking process. The expander may include a housing defining a cavity and a flow path. The cavity may be configured to fluidly communicate with a cooling source, and the flow path may be configured to flow therethrough a flue gas produced by the fluid catalytic cracking process. The expander may also include a rotor disc disposed in the cavity and configured to rotate about a center axis within the housing. The rotor disc may include a rim and a plurality of rotor blades mounted circumferentially about a periphery of the rotor disc, each rotor blade including a root and an airfoil separated by a platform. The expander may further include an annular ring disposed on the rotor disc and defining at least one fluid passageway fluidly coupling the roots and the cooling source. The annular ring may be configured to substantially prevent mixing of the flue gas with a coolant provided by the cooling source and flowing through the at least one fluid passageway and contacting the at least one root. The expander may also include a plurality of seal members. Each seal member may be disposed between respective platforms of adjacent rotor blades and configured to substantially prevent the flue gas flowing though the flow path from mixing with the coolant.

Embodiments of the disclosure may further provide a method for cooling a rotor assembly of an expander receiving flue gas produced from a fluid catalytic cracking process. The method may include fluidly coupling a coolant source to a cavity defined in a housing of the expander. The rotor assembly may include a rotor disc disposed within the cavity and a plurality of rotor blades mounted circumferentially about an outer radial surface of the rotor disc. Each of the rotor blades may include a root and an airfoil separated by a platform. The method may also include disposing an annular ring on a rim of the rotor disc. The annular ring may define at least one fluid passageway fluid coupling the coolant source and the roots. The method may further include disposing a seal member between the platforms of a pair of adjacent rotor blades, and directing coolant from the coolant source through the cavity, the at least one fluid passageway, and the roots. The coolant may cool the rotor assembly and substantially prevent the mixing of the coolant and the flue gas flowing though the expander.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
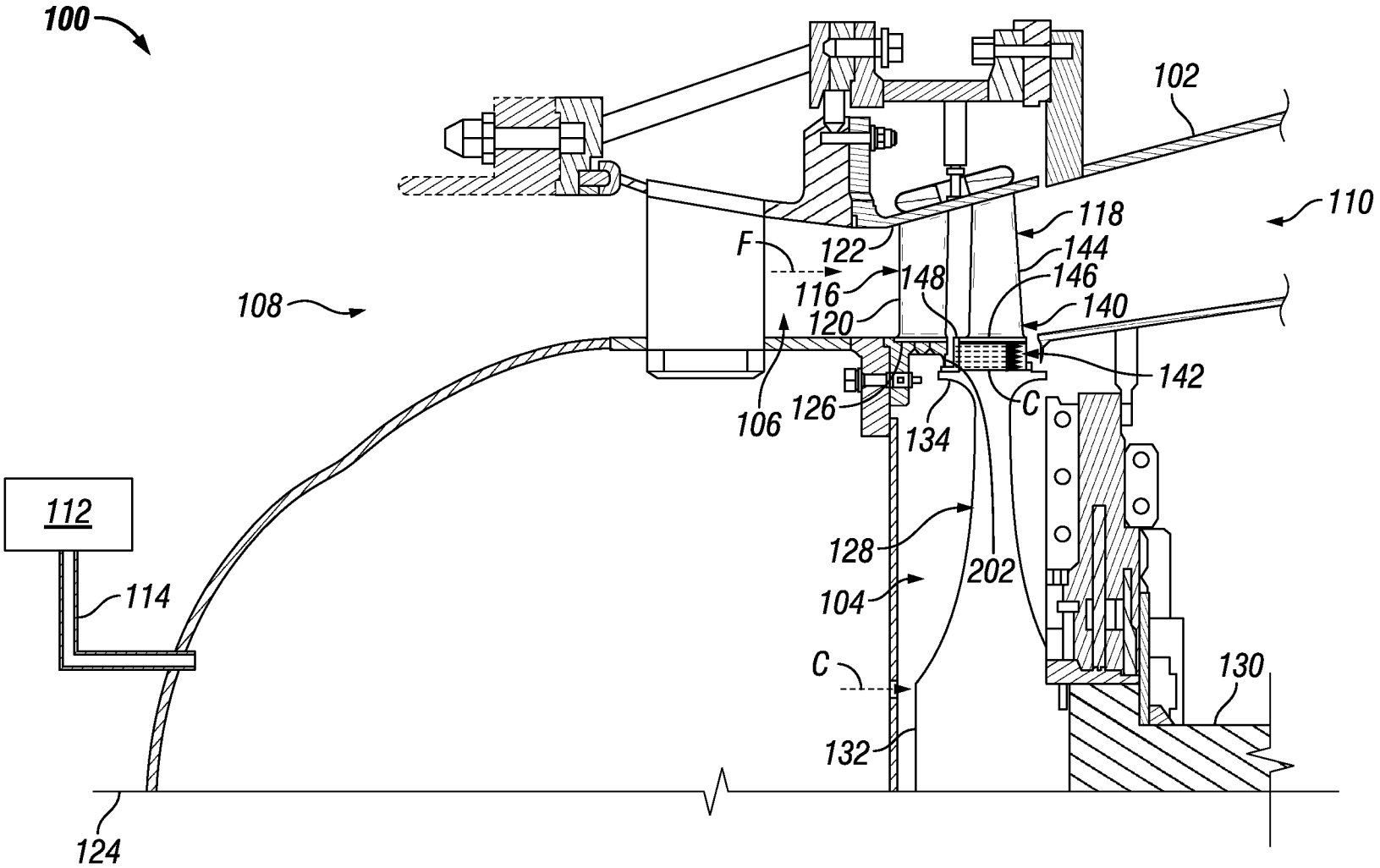
FIG. 1 illustrates a cross-sectional view of a portion of an expander, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

As used herein, the terms "fore" and "upstream," on the one hand, and the terms "aft" and "downstream," on the other hand, are used interchangeably and are intended to indicate positions and directions relative to the principal direction of gas flow over a turbomachine rotor blade airfoil. Thus as will be appreciated by those skilled in the art, in an expander the fore and upstream positions of a rotor and a rotor blade will be at a higher static pressure than the aft and downstream positions. In either case, however, there is a possibility for leakage flow to occur between adjacent blade platforms or between a cavity and flow path, and it is the minimization of such leakage flow to which one or more embodiments of the present disclosure is directed.

As used herein, the term "substantially prevent" means to prevent to a measurable extent, but not necessarily to completely prevent.

Example embodiments disclosed herein provide systems and methods for cooling one or more components of a rotor assembly of an expander receiving flue gas produced from a fluid catalytic cracking (FCC) process. The systems and methods provided herein may also substantially prevent the corrosion and/or erosion of the one or more components of the rotor assembly caused by the hot, catalyst particulate laden flue gas produced from the FCC process. Further, the systems and methods provided herein may substantially prevent the turbulent flow frequently caused by the mixture of the flue gas with a coolant stream provided by a coolant source fluidly coupled to the expander.

In at least one embodiment, the FCC process may convert high-molecular weight hydrocarbon fractions of petroleum crude oils (feedstock) to usable products (e.g., gasoline) with the aid of a catalyst in a reactor (not shown). In operation, the catalyst attaches to and breaks down or "cracks" the vaporized hydrocarbon carbon molecules into smaller molecules via contact and mixing with a powdered catalyst in a catalyst riser (not shown). The hydrocarbon vapors may fluidize the powdered catalyst, and the mixture thereof may flow to the reactor, where the catalyst may be separated from the hydrocarbon product. The separated catalyst may be fed to a regenerator (not shown) where oxygen is reacted with the carbon, and the carbon is burnt off the catalyst. Accordingly, heat is generated and the products of combustion form the flue gas which is carried away from the regenerator towards the expander. Solid catalyst particulate is entrained in the flue gas and the multi-phase mixture is passed through separation stages (e.g., cyclones and/or separators—not shown). Accordingly, a majority of the catalyst is separated from the flue gas in the separation stages. The regenerated catalyst may be returned to the reactor, and the flue gas may be fed to one or more additional separation stages (e.g., cyclones and/or separators—not shown) to remove additional catalyst. The flue gas may then be fed to an expander for power recovery.

FIG. 1 illustrates a cross-sectional view of a portion of an expander 100, according to one or more embodiments disclosed. The expander 100 may be a FCC expander configured to extract and convert energy from flue gas into mechanical work that may be used to drive process machinery or an electrical generator. The expander 100 may be utilized in the FCC process disclosed above or in any other FCC process generating a flue gas. As illustrated in FIG. 1, the expander 100 is a single-stage expander; however, in other embodiments, the expander 100 may be a multi-stage expander. Configuration of the expander 100 may vary based on customer requirements. Generally, the expander 100 may be configured to produce between 3000 hp (2.2 MW) and 60,000 hp (45 MW). Components of the expander 100 may be constructed from one or more corrosion resistant materials. In an exemplary embodiment, one or more components of the expander 100 may be constructed from a superalloy, such as Inconel 718.

As shown in FIG. 1, the expander 100 may have a casing or housing 102 defining a cavity 104 and a flow path 106 extending from a flue gas inlet 108 to a flue gas outlet 110. The flue gas (arrow F) received at the flue gas inlet 108 may have a temperature at about 650° C. to about 790° C. Accordingly, in an exemplary embodiment, the expander 100 may be fluidly coupled with a coolant source 112 via one or more conduits 114. The coolant source may be a steam generation plant or process component (e.g., boiler) capable of supplying a coolant (arrow C), for example, steam or air, to the expander 100. In an exemplary embodiment, the coolant source 112 may be a boiler capable of supplying steam via one or more conduits 114 to the cavity 104 of the expander 100 to cool one or more rotating or stationary components of the expander 100.

As illustrated in FIG. 1, the expander 100 may be a single stage expander including a stator assembly 116 and a rotor assembly 118 axially spaced and downstream from the stator assembly 116. The stator assembly 116 may include a plurality of stator vanes 120 coupled to or adjacent (e.g., a clearance formed therebetween) an inner surface 122 of the housing 102 and disposed circumferentially about and radially outward from a center axis 124 of the expander 100. The stator vanes 120 may be equally spaced about the center axis 124, or in another embodiment, the stator vanes 120 may be arranged asymmetrically about the center axis 124. As arranged, the stator vanes 120 may extend from the inner surface 122 of the housing 102 and into the flow path 106 through which the flue gas (arrow F) passes. Each end portion of the respective stator vanes 120 may be coupled to an inner ring 126 of the stator assembly 116 radially spaced from the inner surface 122 of the housing 102. The stator vanes 120 may be further oriented to increase the velocity of the flue gas (arrow F) flowing therethrough and further direct the flue gas (arrow F) to the axially spaced rotor assembly 118.

The rotor assembly 118 may include a rotor disc 128 disposed in the cavity 104 and axially spaced from the stator assembly 116. The rotor disc 128 may be coupled to or integral with a rotary shaft 130 of the expander 100 and thus configured to rotate therewith about the center axis 124. The rotor disc 128 may include a hub 132 defining a bore and a rim 134 positioned radially outward from the hub 132 adjacent the periphery or outer radial surface 136 (more clearly seen in FIGS. 2A-2C, 5, and 6) of the rotor disc 128. The rim 134 may be formed in the shape of an annular shoulder or lip radially offset from the outer radial surface 136. The outer radial surface 136 of the rotor disc 128 may define a plurality of slots 138 (more clearly seen in FIGS. 2A-2C, 5, and 6) equally spaced circumferentially about the center axis 124.

The rotor assembly 118 may further include a plurality of rotor blades 140 attached to the rotor disc 128 and configured to rotate about the center axis 124 in response to contact from the flue gas (arrow F) exiting the stator vanes 120. Each rotor blade 140 may include a root 142 (more clearly seen in FIGS. 2A-2C, 5, and 6) and an airfoil 144 separated by a platform 146 (more clearly seen in FIGS. 2A-2C, 5, and 6). Each root 142 may be configured to be inserted into and retained in a respective slot 138 (more clearly seen in FIGS. 2A-2C, 5, and 6) defined by the rotor disc 128 via any retaining structure or method known to those of skill in the art. Accordingly, the contour of each root 142 may be provided to match the respective slot 138 defined by the rotor disc 128. In an exemplary embodiment, each root 142 may be shaped in the form of a fir tree and retained in a matching respective slot 138. As disposed in the expander 100, the airfoil 144 of each rotor blade 140 may extend into the flow path 106 and may be contacted by the flue gas (arrow F) exiting the stator vanes 120, thereby rotating the rotor blades 140 and the rotary disc 128 coupled therewith about the center axis 124.

In at least one embodiment, the expander 100 may be a multistage expander including a first stage as disclosed above with one or more succeeding stages. In at least one embodiment, a power generator (not shown) may be coupled with the expander 100 via the rotary shaft 130 and configured to convert the rotational energy into electrical energy. The electrical energy may be transferred or delivered from the power generator to an electrical grid (not shown) via a power outlet (not shown) coupled therewith. In another embodiment, a compressor, pump, or other process component (not shown) may be coupled with the expander 100 via the rotary shaft 130 and driven by the expander 100.

Figure 2A:
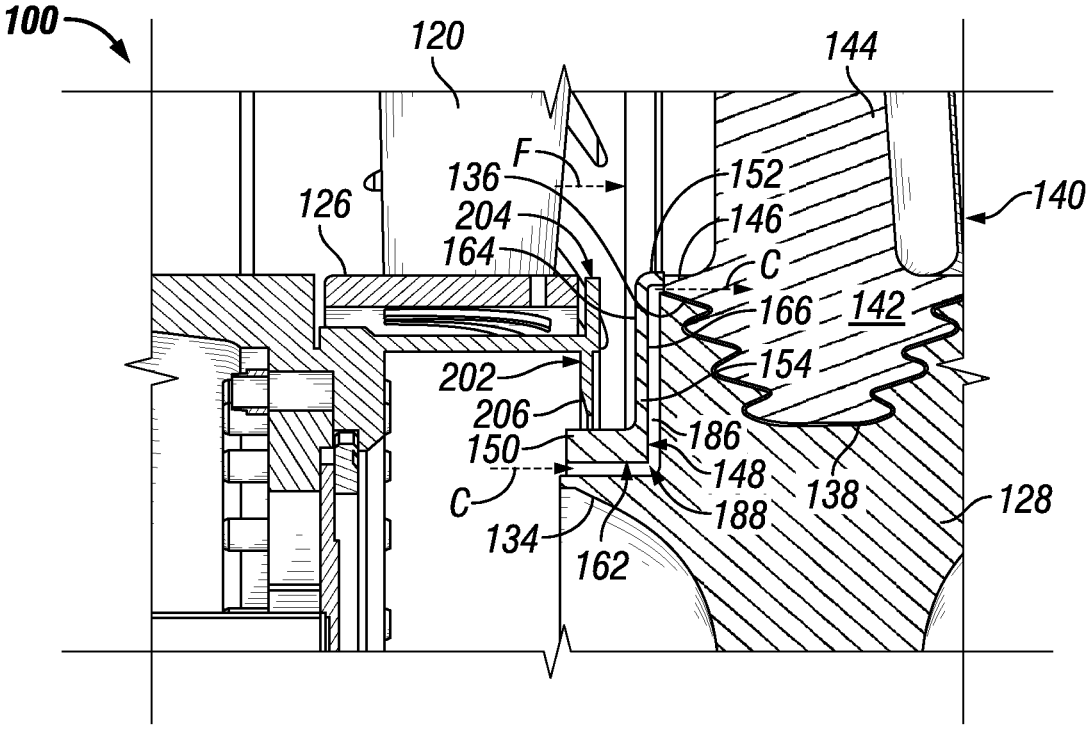
FIG. 2A illustrates an enlarged cross sectional view of a portion of the expander illustrated in FIG. 1, according to one or more embodiments.
Figure 2B:
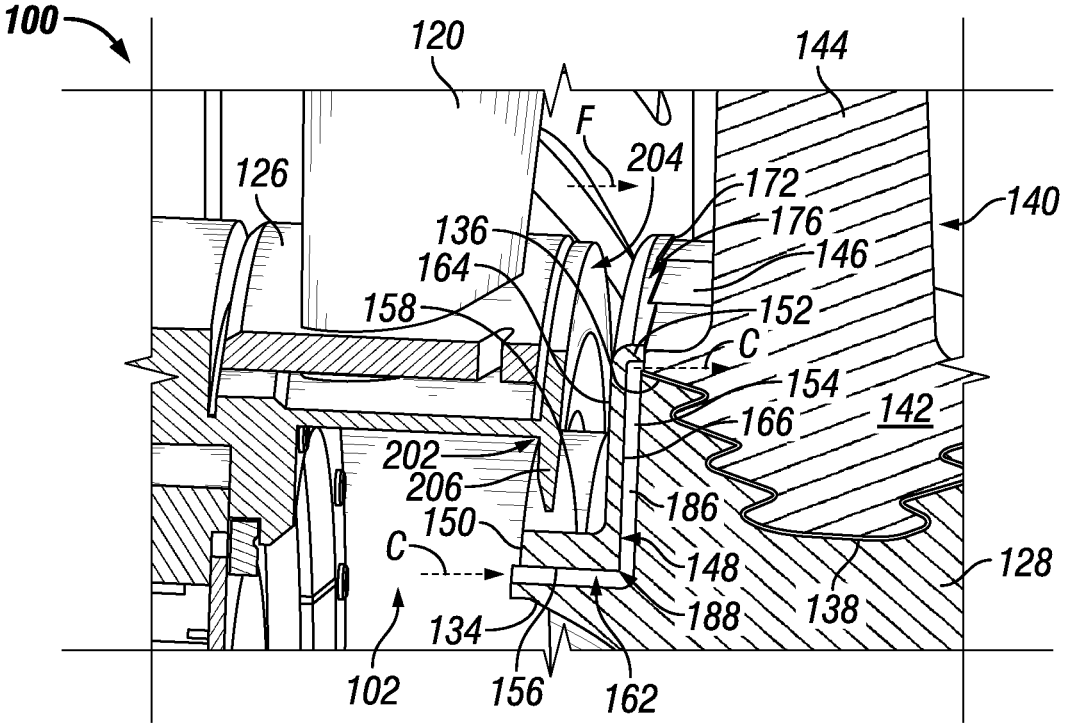
FIG. 2B illustrates another enlarged cross sectional view of a portion of the expander illustrated in FIG. 1, according to one or more embodiments.
Figure 2C:
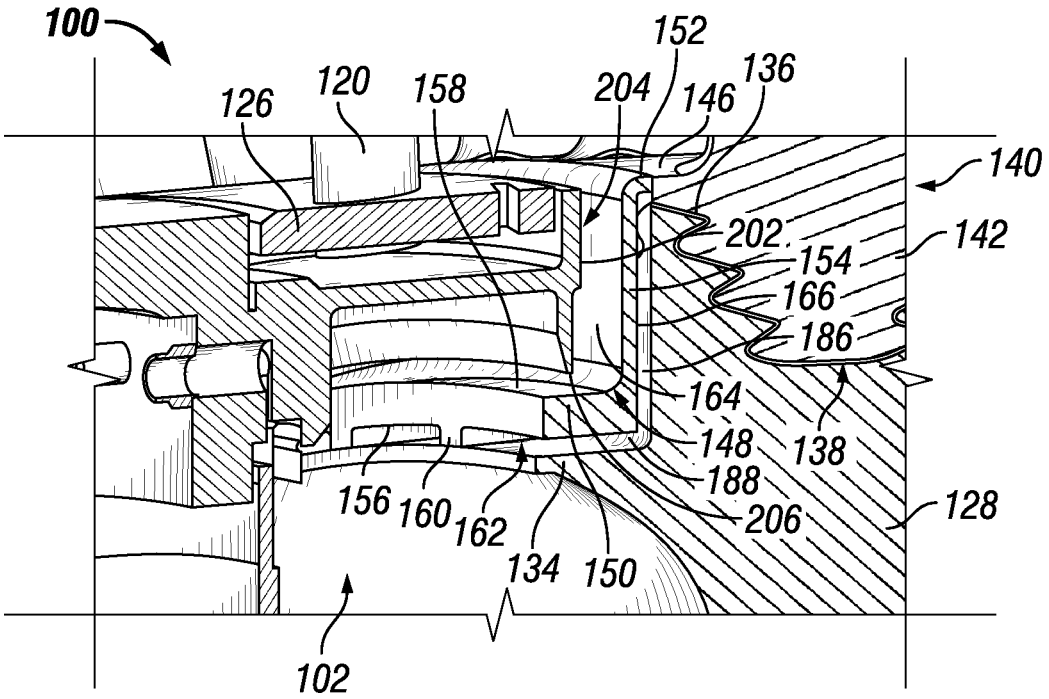
FIG. 2C illustrates another enlarged cross sectional view of a portion of the expander illustrated in FIG. 1, according to one or more embodiments.
Figure 3A:
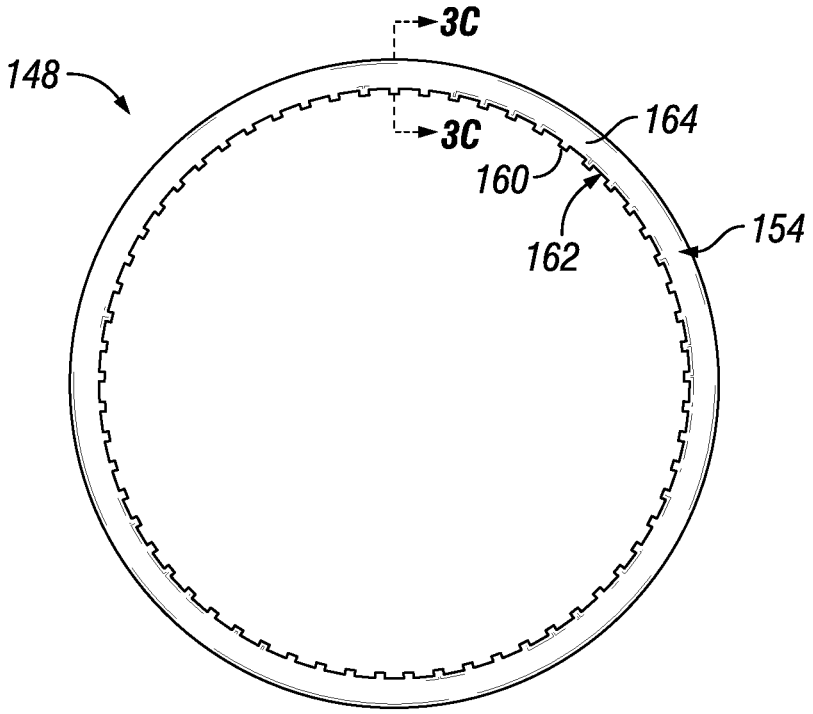
FIG. 3A illustrates a front view of an upstream side of an annular ring, according to one or more embodiments.
Figure 3B:
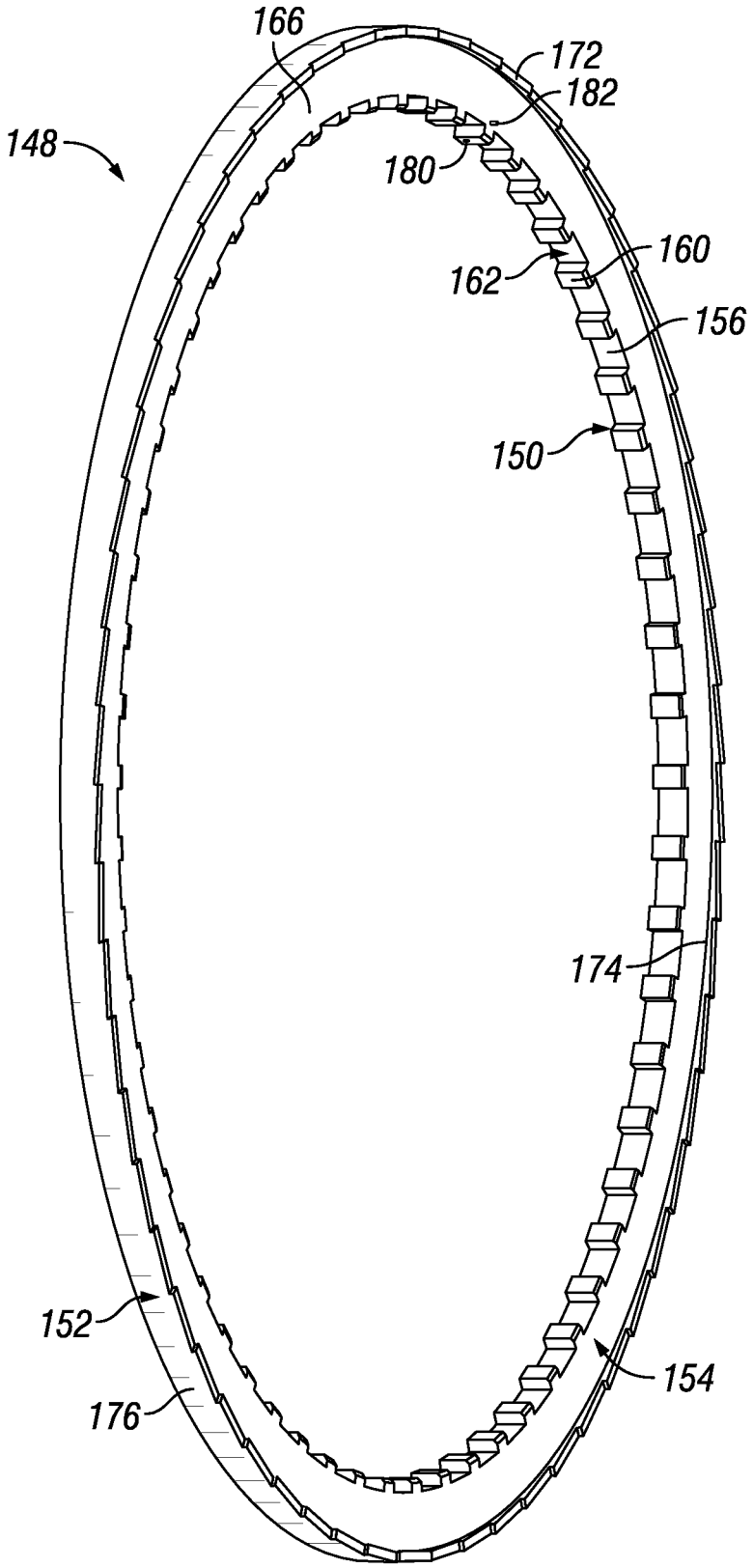
FIG. 3B illustrates a perspective view of a downstream side of the annular ring of FIG. 3A, according to one or more embodiments.
Figure 3C:
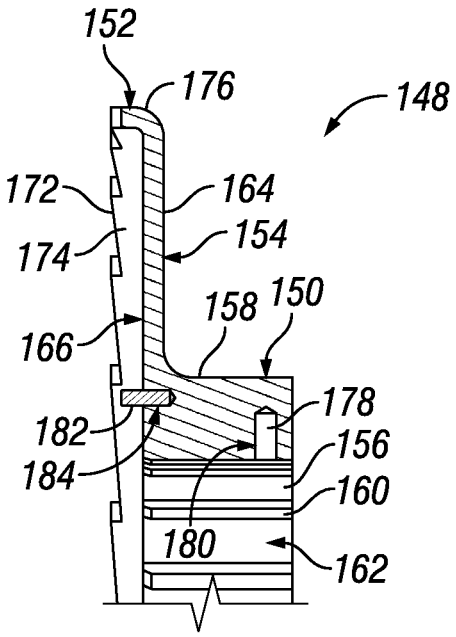
FIG. 3C illustrates a cross-sectional view of the annular ring of FIG. 3A taken along line 3C-3C, according to one or more embodiments.

Referring now to FIGS. 2A-2C and 3A-3C with continued reference to FIG. 1, the expander may include an annular body or ring 148 configured to be disposed or mounted on the rim 134 of the rotor disc 128 and direct the flow of coolant (arrow C) across the respective roots 142 of the rotor blades 140. FIGS. 2A-2C illustrate differing enlarged cross-sectional views of a portion of the expander 100 illustrated in FIG. 1 including the annular ring 148, according to one or more embodiments. FIG. 3A illustrates a front view of an upstream side of the annular ring 148, according to one or more embodiments. FIG. 3B illustrates a perspective view of a downstream side of the annular ring 148 of FIG. 3A, according to one or more embodiments. FIG. 3C illustrates a cross-sectional view of a portion of the annular ring 148 of FIG. 3A taken along line 3C-3C, according to one or more embodiments. The annular ring 148 may be further configured to substantially prevent mixing of the flue gas (arrow F) and the coolant (arrow C), thereby substantially preventing the catalyst particulate entrained in the flue gas from contacting the portions of the rotor disc 128 and rotor blades 140 subjected to the coolant (arrow C) provided by the coolant source 112, and thus, preventing the corrosion and/or erosion of the rotor disc 128 and rotor blades 140 caused by the hot, corrosive, particulate laden flue gas produced from the FCC process and improving the effectiveness of the cooling flow by reducing the mixture of the coolant (arrow C) and the flue gas (arrow F).

In an exemplary embodiment, the annular ring 148 may include an axial member or portion 150 connected to and spaced radially inward from another axial member or portion 152 by a radial member or portion 154. The axial member 150 may include a radial inner surface 156 and a radial outer surface 158. A plurality of axial ribs 160 may extend from the inner radial surface 156 and may be configured to be disposed on the rim 134, and in addition, disposed circumferentially about the rim 134 of the rotor disc 128. Each axial rib 160 and an adjacent axial rib 160 may form an axial slot 162 therebetween. The axial ribs 160 may be spaced equidistantly from one another thereby forming substantially equal axial slots 162, or in another embodiment, the spacing between axial ribs 160 may differ between at least two pairs of adjacent axial ribs 160.

Figure 4:
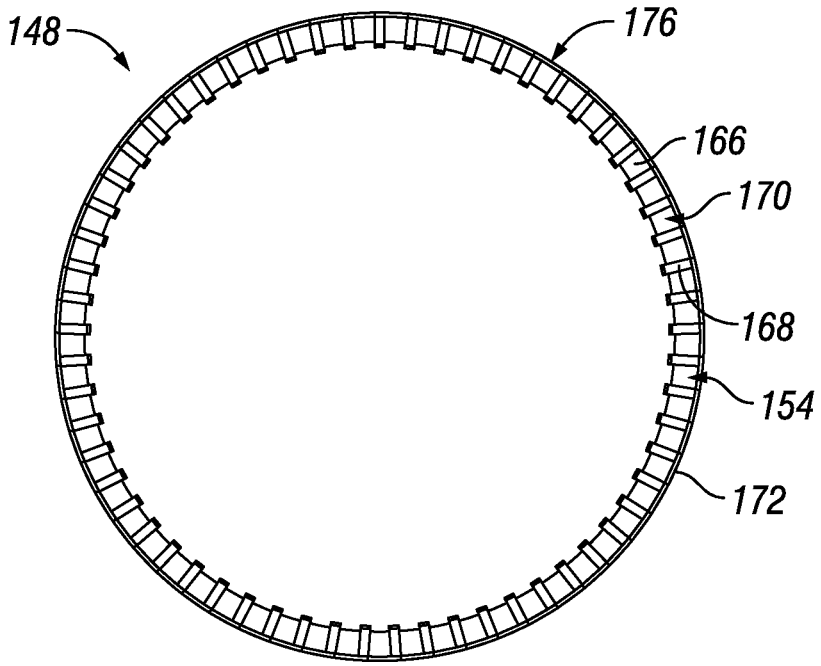
FIG. 4 illustrates a front view of a downstream side of another annular ring including a plurality of radial ribs, according to one or more embodiments.

The radial member 154 may extend radially outward from the axial member 150 and may include an upstream surface 164 (most clearly seen in FIG. 3A) and a downstream surface 166 (most clearly seen in FIG. 3B). In one embodiment illustrated in FIG. 4, a plurality of radial ribs 168 may extend axially from the downstream surface 166 and may be positioned circumferentially about the center axis 124, each radial rib 168 and an adjacent radial rib 168 forming a radial slot 170 therebetween. The radial ribs may be spaced equidistantly from one another thereby forming substantially equal radial slots 170, or in another embodiment, the spacing between radial ribs 168 may differ between at least two pairs of adjacent radial ribs 168.

As illustrated most clearly in FIG. 3B, the axial member 152 of the annular ring 148 may extend axially from the radial member 154 and terminate in a plurality of teeth 172 arranged in a saw-tooth configuration. The saw-tooth configuration of the plurality of teeth 172 may be arranged to engage and fit the contour of the plurality of platforms 148 of the rotary blades 140 (most clearly seen in FIG. 2B), thereby forming a substantially sealing relationship with the plurality of rotor blades 140. In another embodiment, the axial member 152 may terminate in a flat, or planar, face (not shown). The axial member 152 may have an inner radial surface 174 and an outer radial surface 176 and may extend axially from the radial member 154 in a direction opposing the axial orientation of the axial member 150.

As shown in FIGS. 1 and 2A-2C, the annular ring 148 may be disposed on and coupled to the rim 134 of the rotor disc 128. In an exemplary embodiment, the annular ring 148 may be coupled to the rotor disc 128 via an interference fit. In other embodiments, the annular ring 148 may be coupled to the rotor disc 128 via mechanical fasteners, such as bolts or pins. In one embodiment, the annular ring may be coupled to the rotor disc via one or more pins 178 (most clearly seen in FIG. 3C) inserted through aligned apertures 180 defined in the axial member 150 of the annular ring 148 and the rim 134 of the rotor disc 128 to assist in preventing rotation in the circumferential direction or axial movement during operation. In another embodiment, the annular ring 148 may include one or more pins 182 inserted into apertures 184 defined in the radial member 154 of the annular ring 148 and extending therefrom a predetermined amount to create an annular gap 186 between the annular ring 148 and the rotor disc 128 in embodiments in which the radial member 154 does not include the radial ribs 168 extending from the downstream surface 166 thereof.

In an exemplary embodiment, the annular ring 148 may be constructed with and/or coated with a corrosion and/or erosion resistant material. In another embodiment, at least one of the annular ring 148, at least a portion of the rotor disc 128, and at least a portion of the rotor blades 140 may be coated with a corrosion and/or erosion resistant material. In an exemplary embodiment, the corrosion and/or erosion resistant material may be SDG-2207 manufactured by Praxair Surface Technologies of Houston, Tex.

As disposed on and coupled to the rotor disc 128, the annular ring 148 and the rotor disc 128 may define one or more fluid passageways 188 configured to fluidly couple the coolant source 112 with each of the roots 142. In an exemplary embodiment, the one or more fluid passageways 188 may be defined by the axial slots 162 and the annular gap 186 between the radial member 154 of the annular ring 148 and the rotor disc 128. The one or more fluid passageways 188 may fluidly couple the cooling source 112 and the roots 142 of the plurality of rotor blades 140, thereby providing a pathway for the coolant (arrow C) to contact the respective roots 142 of the plurality of rotor blades 140 while the annular ring 148 shields the roots 142 and flow of coolant (arrow C) from the flue gas (arrow F) passing through the flow path 106. In another embodiment, the downstream surface 166 of the annular ring 148 may include the plurality of radial ribs 168, and each of the radial ribs 168 may be circumferentially aligned with a respective axial rib 160 such that each radial slot 170 may be circumferentially aligned with a respective axial slot 162 to form a respective fluid passageway 188 bounded by the rotor disc 128, such that each fluid passageway 188 may fluidly couple the cooling source 112 and at least one root 142 of the plurality of rotor blades 140. Accordingly, the annular ring 148 may be configured to substantially prevent mixing of the flue gas (arrow F) with the coolant (arrow C) provided by the cooling source 112 and flowing through the plurality of fluid passageways 188 and contacting the respective roots 142.

Figure 5:
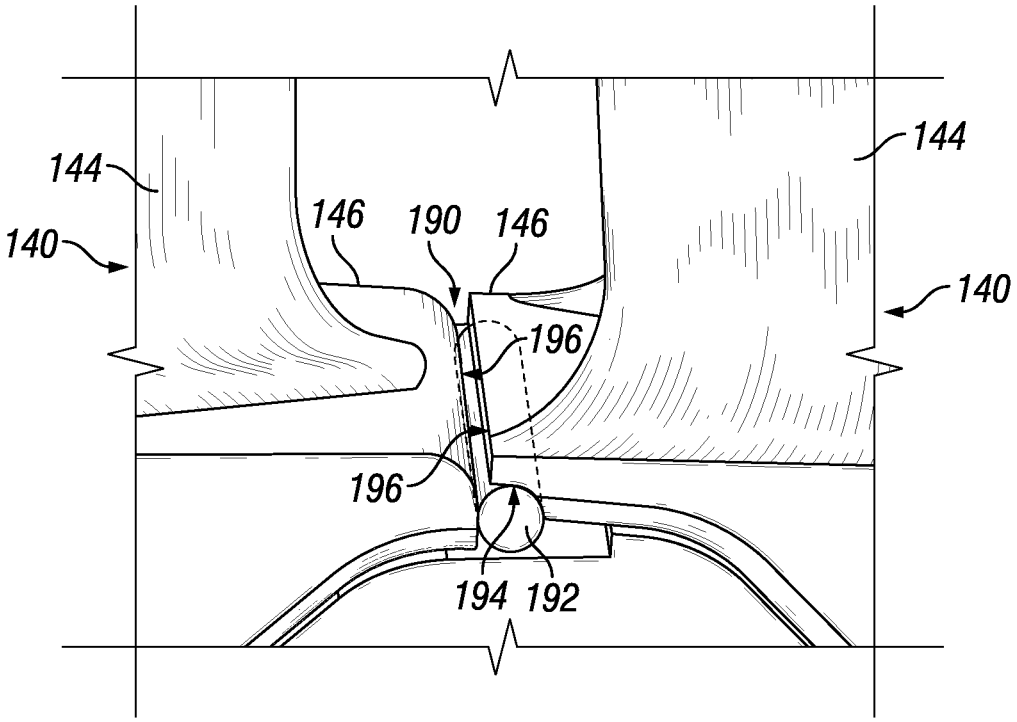
FIG. 5 illustrates a perspective view of a seal member disposed between adjacent rotor blades of the rotor assembly, according to one or more embodiments.
Figure 6:
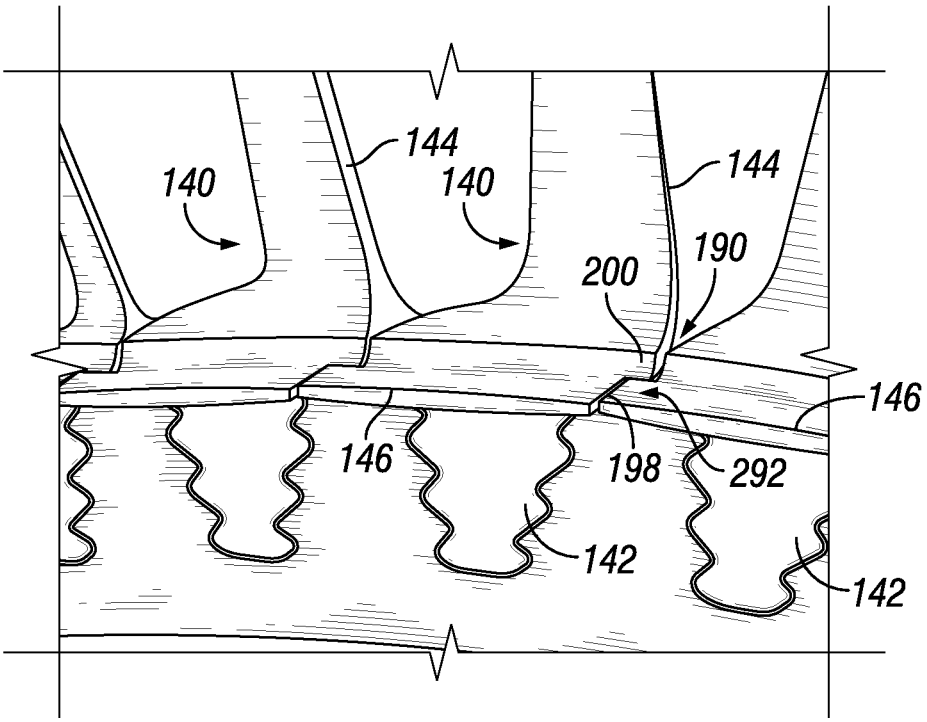
FIG. 6 illustrates a perspective view of another seal member disposed between adjacent rotor blades of the rotor assembly, according to one or more embodiments.

Referring now to FIGS. 5 and 6 with continued reference to FIGS. 1 and 2A-2C, as the rotor blades 140 are inserted into and retained by the rotor disc 128, a small axial gap 190 may occur between the platforms 146 of the adjacent rotor blades 140. Accordingly, the expander 100 may include a seal member 192, 292 disposed between respective platforms 146 of adjacent rotor blades 142. FIG. 5 illustrates a perspective view of a seal member 192 disposed between adjacent rotor blades 140 of the rotor assembly 118, according to one or more embodiments. FIG. 6 illustrates a perspective view of another seal member 292 disposed between adjacent rotor blades 140 of the rotor assembly 118, according to one or more embodiments. As illustrated in the embodiments of FIGS. 5 and 6, the seal member 192, 292 is configured to substantially prevent the flue gas (arrow F) flowing though the expander 100 from contacting the respective roots 142 and/or entering the cavity 104.

In an exemplary embodiment, the seal member 192 may be or include a sealing wire disposed in a groove formed between the respective platforms 146 of the adjacent rotor blades 140, as shown in FIG. 5. The seal wire 192 may have an annular shape and a predetermined length substantially equal to or greater than the length of the platform 146 parallel to the center axis 124 of the expander 100. In an exemplary embodiment, the sealing wire 192 may be formed from Stellite® manufactured by the Kennametal Stellite Company of Goshen, Ind. In another embodiment, the sealing wire 192 may be formed from a cobalt-based alloy, such as Haynes 188, a nickel-based alloy, such as In-718, or an iron-based alloy, such as A-286. In another embodiment, the sealing wire 192 may be or may be formed from a welding rod. A groove 194 may be formed in at least one facing side surface 196 of the platforms 146 of the adjacent rotor blades 140. The sealing wire 192 may be disposed in the formed groove 194 of the adjacent platforms 146, thereby closing and sealing the axial gap 190 between the platforms 146 of the adjacent rotor blades 140, and thus, substantially preventing an amount of flue gas (arrow F) flowing though the flow path 106 in the expander 100 from contacting the respective roots 142 and/or entering the cavity 104.

In another embodiment, the seal member may include a sealing strip (not shown) formed in a C-shape and configured to be inserted between respective platforms 146 of adjacent rotor blades 140. As formed, the sealing strip may include a planar section bounded by opposing curved sections. A slot (not shown) may be formed in respective facing side surfaces 196 of the platforms 146 of the adjacent rotor blades 140. The planar section of the sealing strip may be disposed in each slot of the adjacent platforms 146, thereby closing and sealing the axial gap 190 between the platforms 146 of the adjacent rotor blades 140, and thus, substantially preventing an amount of flue gas (arrow F) flowing though the flow path 106 in the expander 100 from contacting the respective roots 142 and/or entering the cavity 104.

In another embodiment, as illustrated in FIG. 6, the seal member 292 may be or include a ship lap formed from the respective platforms 146. The ship lap 292 may be formed by one platform 146 of the respective platforms 146 including a rotationally rearward edge portion 198 that underlies a rotationally forward edge portion 200 on an adjacent platform 146. The rotationally rearward edge portion 198 and the forward edge portion 200 on the adjacent platform 146 may be positioned such that a seal may be formed therebetween, thereby closing and sealing the axial gap 190 between the platforms 146 of the adjacent rotor blades 140, and thus, substantially preventing an amount of flue gas (arrow F) flowing though the flow path 106 in the expander 100 from contacting the respective roots 142 and/or entering the cavity 104.

As shown in FIG. 1, the plurality of stator vanes 120 mounted circumferentially about an interior surface 122 of the housing 102 may each include an end portion radially opposing the inner surface 122 of the housing 102 and connected via the inner stator ring 126. In an exemplary embodiment, a labyrinth seal 202 may be coupled to or integral with the aft or downstream portion 204 of the inner stator ring 126 of the stator assembly 116. Accordingly, a portion of the axially extending downstream portion 204 of the inner stator ring 126 may be removed via machining to accommodate the labyrinth seal 202. The labyrinth seal 202 may include or define one or more teeth 206 (one shown in FIGS. 2A-2C) extending radially inward and disposed adjacent the axial member 150 of the annular ring 148. As arranged, the labyrinth seal 202 may form a sealing relationship with the axial member 150 of the annular ring 148 and thus may be configured to substantially prevent the flow of coolant (arrow C) from the cavity 104 into the flow path 106, or the flow of flue gas (arrow F) into the cavity 104. Accordingly, the labyrinth seal 202 and the annular ring 148 as arranged may substantially prevent mixing of the flue gas (arrow F) and coolant (arrow C), thereby resulting in a reduction of turbulence in the region.

Turning now to an exemplary operation of the expander 100 with reference to FIGS. 1-6, flue gas (arrow F) produced from a FCC process may be passed through the flow path 106 of the expander 100 from the flue gas inlet 108 to the flue gas outlet 110. As the flue gas passes through the stator vanes 120, the velocity of the flue gas flowing therethrough is increased and the flue gas is directed to the axially spaced rotary blades 140. As disposed in the expander 100, the airfoil 144 of each rotor blade 140 may extend into the flow path 106 and may be contacted by the flue gas (arrow F) exiting the stator vanes 120, thereby rotating the rotor blades 140 and the rotary disc 128 coupled therewith about the center axis 124. The rotary disc 128 may be further coupled with the rotary shaft 130. A process component, such as a pump, generator, or compressor (not shown) may be coupled with the expander 100 via the rotary shaft 130 and driven by the expander 100, thus achieving power recovery.

As the flue gas passing though the expander 100 may be a hot, particulate laden flue gas produced from the FCC process, the expander 100 may receive a coolant (arrow C) from a cooling source 112 fluidly coupled with the cavity 104 defined by the expander 100. The coolant (arrow C) may be provided to cool the rotor assembly 118 and other components in thermal communication with the flue gas (arrow F). The annular ring 148 may be mounted on the rim 134 of the rotor disc 128 of the rotor assembly and may be configured to direct the coolant flow over at least a portion of the rotor assembly 118 via one or more fluid passageways 188 defined by the annular ring 148 and may be further configured to further substantially prevent mixing of the flue gas (arrow F) and the coolant (arrow C). Further, as disposed on the rotor disc 128, the annular ring 148 may provide a shield or barrier for the roots 142 from contact with the flue gas (arrow F). In an exemplary embodiment, the labyrinth seal 202 may be integral with or coupled with the inner stator ring 126 and disposed adjacent the annular ring 148, thereby forming a sealing relationship therewith and substantially preventing mixing of the flue gas (arrow F) and the coolant (arrow C). A seal member 192, 292 may be disposed between respective platforms 146 of adjacent rotor blades 140 to seal the axial gap 190 formed therebetween.

Figure 7:
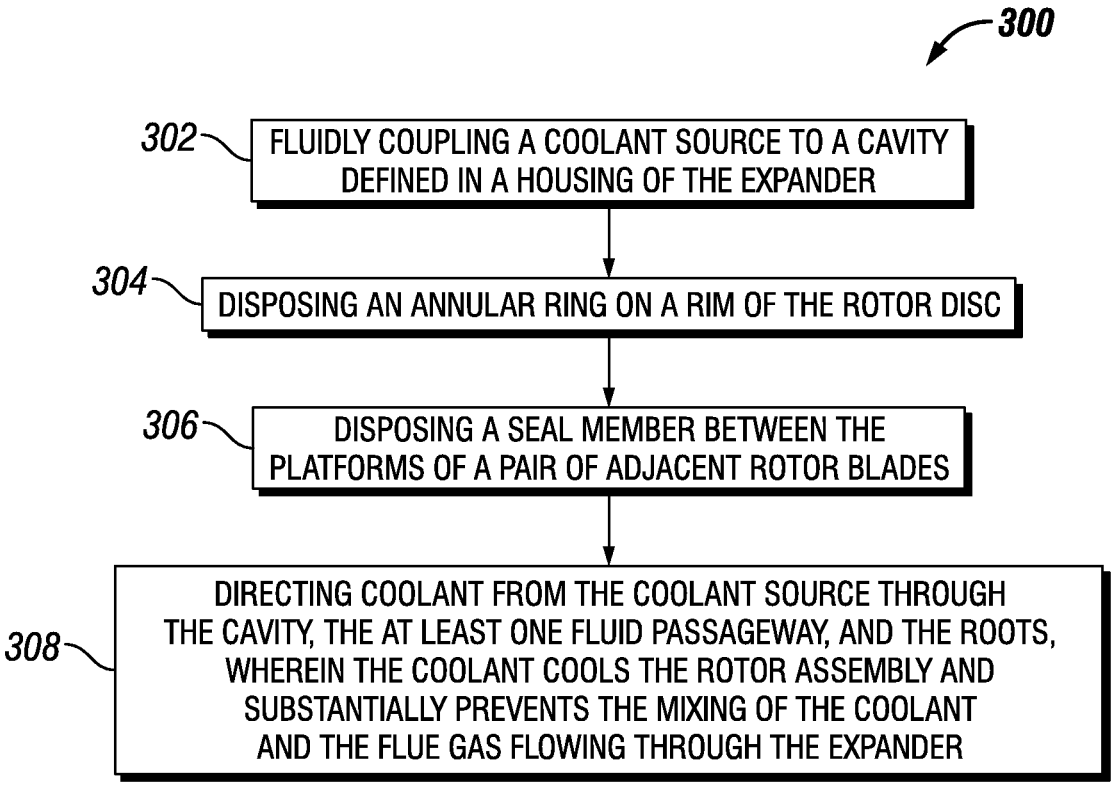
FIG. 7 is a flowchart depicting a method for cooling a rotor assembly of an expander receiving flue gas produced from a fluid catalytic cracking process, according to one or more embodiments.

FIG. 7 is a flowchart depicting a method 300 for cooling a rotor assembly of an expander receiving flue gas produced from a fluid catalytic cracking process, according to one or more embodiments. The method 300 may include fluidly coupling a coolant source to a cavity defined in a housing of the expander, as at 302. The rotor assembly may include a rotor disc disposed within the cavity and a plurality of rotor blades mounted circumferentially about an outer radial surface of the rotor disc, and each of the rotor blades may include a root and an airfoil separated by a platform. The method 300 may also include disposing an annular ring on a rim of the rotor disc, as at 304.

The annular ring may define at least one fluid passageway fluidly coupling the coolant source and the roots. The annular ring may include a first axial portion having a plurality of axial ribs disposed on and circumferentially about the rim of the rotor disc. Each axial rib and an adjacent axial rib may form an axial slot therebetween. The annular ring may also include a radial portion extending radially outward from the first axial portion. In one embodiment, the radial portion may include a plurality of radial ribs positioned circumferentially about a center axis of the expander. Each radial rib and an adjacent radial rib may form a radial slot therebetween. The annular ring may further include a second axial portion extending axially from the radial portion and including a plurality of teeth having a saw-tooth configuration.

The method 300 may further include disposing a seal member between the platforms of a pair of adjacent rotor blades, as at 306, and directing coolant from the coolant source through the cavity, the at least one fluid passageway, and the roots, where the coolant cools the rotor assembly and substantially prevents the mixing of the coolant and the flue gas flowing though the expander, as at 308. The seal member may include a sealing wire disposed in a groove formed between the respective platforms of the adjacent rotor blades. In another embodiment, the method 300 may also include disposing a labyrinth seal adjacent the annular ring, the labyrinth seal coupled to a stator vane assembly of the expander and configured to substantially prevent coolant from entering the flow path and mixing with the flue gas.

It should be appreciated that all numerical values and ranges disclosed herein are approximate valves and ranges, whether "about" is used in conjunction therewith. It should also be appreciated that the term "about," as used herein, in conjunction with a numeral refers to a value that is +/−5% (inclusive) of that numeral, +/−10% (inclusive) of that numeral, or +/−15% (inclusive) of that numeral. It should further be appreciated that when a numerical range is disclosed herein, any numerical value falling within the range is also specifically disclosed.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. An expander for a fluid catalytic cracking process, comprising:

a housing defining a cavity and a flow path, the cavity configured to fluidly communicate with a cooling source, and the flow path configured to flow therethrough a flue gas produced by the fluid catalytic cracking process;

a rotor disc disposed in the cavity and configured to rotate about a center axis within the housing, the rotor disc comprising a rim and a plurality of rotor blades mounted circumferentially about a periphery of the rotor disc, each rotor blade comprising a respective root and an airfoil separated by a platform of a plurality of platforms;

an annular ring disposed on the rotor disc and defining a plurality of fluid passageways fluidly coupling the respective roots and the cooling source, the annular ring configured to substantially prevent mixing of the flue gas with a coolant provided by the cooling source and flowing through the plurality of fluid passageways and contacting at least one of the respective roots; and a plurality of seal members, each seal member disposed between respective platforms of adjacent rotor blades and configured to substantially prevent the flue gas flowing though the flow path from mixing with the coolant, wherein the annular ring comprises:

a plurality of axial ribs protruding radially inwardly from an inner radial surface of a first axial portion of the annular ring, the first axial portion extending between an upstream end of the first axial portion and a downstream end of the first axial portion, the plurality of axial ribs disposed on and circumferentially about the rim of the rotor disc, each axial rib and an adjacent axial rib of the plurality of axial ribs forming an axial slot therebetween;

a radial portion extending radially outward from the downstream end of the first axial portion and axially spaced from the rotor disc; and a second axial portion extending axially from a radially outwardly end of the radial portion and comprising a plurality of teeth having a saw tooth configuration arranged to engage a corresponding platform of the plurality of platforms, a plurality of radial ribs protruding downstream from a downstream surface of the radial portion of the annular ring, the plurality of radial ribs positioned circumferentially about the center axis, each radial rib and an adjacent radial rib of the plurality of radial ribs that protrude downstream from the downstream surface of the radial portion of the annular ring forming a radial slot therebetween, wherein each radial rib of the plurality of radial ribs is circumferentially aligned with a respective axial rib such that each radial slot is circumferentially aligned with a respective axial slot to form a respective fluid passageway of the plurality of fluid passageways.

2. The expander of claim 1, wherein at least one seal member of the plurality of seal members comprises a sealing wire disposed in a groove formed between the respective platforms of the adjacent rotor blades.

3. The expander of claim 1, wherein at least one seal member of the plurality of seal members is a ship lap formed by the respective platforms, the ship lap formed by a platform of the respective platforms comprising a rotationally rearward edge portion that underlies a rotationally forward edge portion on an adjacent platform.

4. The expander of claim 1, wherein an outer radial surface of the rotor disc defines a plurality of slots, and the root of each rotor blade is fitted in a respective slot of the plurality of slots.

5. The expander of claim 1, wherein the annular body is disposed on the rim of the rotor disc via an interference fit.

6. The expander of claim 1, further comprising:

a stator vane assembly including a plurality of stator vanes mounted circumferentially about an interior surface of the housing, each end portion of the respective stator vanes coupled to an inner stator ring; and a labyrinth seal integral with or coupled to an axial end portion of the inner stator ring proximal the first axial portion of the annular ring.

7. The expander of claim 6, wherein the labyrinth seal comprises one or more teeth forming a sealing relationship with the annular ring, such that the coolant is substantially prevented from mixing with the flue gas in the flow path.

8. A method for cooling a rotor assembly of an expander receiving flue gas produced from a fluid catalytic cracking process, the method comprising:

fluidly coupling a coolant source to a cavity defined in a housing of the expander, the rotor assembly comprising a rotor disc disposed within the cavity and a plurality of rotor blades mounted circumferentially about an outer radial surface of the rotor disc, and each of the rotor blades including a root and an airfoil separated by a platform of a plurality of platforms;

disposing an annular ring on a rim of the rotor disc, the annular ring defining at least one fluid passageway fluid coupling the coolant source and the roots;

disposing a seal member between the platforms of a pair of adjacent rotor blades; and directing coolant from the coolant source through the cavity, the at least one fluid passageway, and the roots, wherein the coolant cools the rotor assembly and substantially prevents mixing of the coolant and the flue gas flowing though the expander, wherein the annular ring comprises:

a plurality of axial ribs protruding radially inwardly from an inner radial surface of a first axial portion of the annular ring, the first axial portion extending between an upstream end of the first axial portion and a downstream end of the first axial portion, the plurality of axial ribs disposed on and circumferentially about the rim of the rotor disc, each axial rib and an adjacent axial rib of the plurality of axial ribs forming an axial slot therebetween;

a radial portion extending radially outward from the downstream end of the first axial portion and axially spaced from the rotor disc; and a second axial portion extending axially from a radially outwardly end of the radial portion and comprising a plurality of teeth having a saw tooth configuration arranged to engage a corresponding platform of the plurality of platforms, a plurality of radial ribs protruding downstream from a downstream surface of the radial portion of the annular ring, the plurality of radial ribs positioned circumferentially about the center axis, each radial rib and an adjacent radial rib of the plurality of radial ribs that protrude downstream from the downstream surface of the radial portion of the annular ring forming a radial slot therebetween, wherein each radial rib of the plurality of radial ribs is circumferentially aligned with a respective axial rib such that each radial slot is circumferentially aligned with a respective axial slot to form a respective fluid passageway of the plurality of fluid passageways.

9. The method of claim 8, further comprising:

disposing a labyrinth seal adjacent the annular ring, the labyrinth seal integral with or coupled to a stator vane assembly of the expander and configured to substantially prevent the coolant from entering the flow path and mixing with the flue gas.

* * * * *